US008093976B2

(12) United States Patent
Shimizu et al.

(10) Patent No.: US 8,093,976 B2
(45) Date of Patent: Jan. 10, 2012

(54) VEHICLE SWITCH

(75) Inventors: Masaru Shimizu, Kyoto (JP); Kiyotaka Uehira, Osaka (JP); Toshio Osawa, Nara (JP)

(73) Assignee: Panasonic Corporation, Osaka (JP)

( * ) Notice: Subject to any disclaimer, the term of this patent is extended or adjusted under 35 U.S.C. 154(b) by 403 days.

(21) Appl. No.: 12/240,097

(22) Filed: Sep. 29, 2008

(65) Prior Publication Data

US 2009/0153278 A1 Jun. 18, 2009

(30) Foreign Application Priority Data

Dec. 13, 2007 (JP) ..... 2007-321839

(51) Int. Cl.
*H01H 9/00* (2006.01)

(52) U.S. Cl. ..... 335/205

(58) Field of Classification Search ..... 335/205–208; 338/32 R, 32 H
See application file for complete search history.

(56) References Cited

U.S. PATENT DOCUMENTS

| | | | | | |
|---|---|---|---|---|---|
| 3,571,774 | A * | 3/1971 | Hubrich | 338/32 R |
| 3,656,181 | A * | 4/1972 | Pack | 335/205 |
| 3,689,859 | A * | 9/1972 | Straub | 335/206 |
| 3,848,216 | A * | 11/1974 | Gamble | 338/32 H |
| 3,873,957 | A * | 3/1975 | Wurscher et al. | 335/207 |
| 5,057,807 | A * | 10/1991 | Longly et al. | 335/207 |
| 6,097,272 | A * | 8/2000 | Grover et al. | 335/207 |
| 6,223,571 | B1 * | 5/2001 | Rector | 70/276 |
| 6,867,680 | B1 * | 3/2005 | Kulle | 338/32 H |
| 2007/0290642 | A1 | 12/2007 | Shimizu et al. | |

FOREIGN PATENT DOCUMENTS

JP 2006-092777 4/2006

* cited by examiner

*Primary Examiner* — Bernard Rojas
(74) *Attorney, Agent, or Firm* — Wenderoth, Lind & Ponack, LLP.

(57) ABSTRACT

A vehicle switch has a case, a movable body, a spring, a magnet, a detector, and an operating shaft. The movable body is reciprocably accommodated in the case. The spring pushes the movable body in a direction away from an internal bottom of the case. The magnet is attached to the movable body. The detector detects a magnetic flux density generated from the magnet. A lower end of the operating shaft is in contact with the movable body. The movable body has a press contact portion with which the operating shaft is in contact at a point or along a line.

17 Claims, 7 Drawing Sheets

VEHICLE SWITCH

1. FIELD OF INVENTION

The present invention relates to a vehicle switch which is used, for example, mainly for turning on and off a stop lamp when a brake pedal of the vehicle is operated.

2. BACKGROUND OF INVENTION

When a brake pedal is pressed down, a stop lamp is turned on, and when the pedal is released, the lamp is turned off. In recent years, this kind of push type vehicle switch has been widely used for controlling a stop lamp when the brake pedal is operated. A conventional vehicle switch of this type is described with reference to FIG. 7.

FIG. 7 is a cross sectional view of a conventional vehicle switch. Case 1 made of insulating resin and formed essentially in a box shape has an opening at its top portion. Operating body 2 is accommodated in case 1 movably in up and down directions. Magnet 3 is attached to a lower left side of operating body 2. Terminals 4 are made of metal, and a lower end of each of terminals 4 is projected downward from a bottom of case 1. Wiring board 5 is disposed in a left side of operating body 2 inside case 1. On left and right sides of wiring board 5, wiring patterns (not illustrated) are formed. An upper end of terminal 4 is connected to the one of the wiring patterns of wiring board 5 by soldering, for instance.

On wiring board 5, detector 6 composed of a hall element is formed facing magnet 3. On wiring board 5, switching part 7 composed of a power transistor, and controller 8 composed of an FET, resistors and the like are also formed. Detector 6 and switching part 7 are connected to controller 8.

Controller 8 switches switching part 7 in response to a magnitude of magnetism detected by detector 6. When a magnetic flux density detected by detector 6 is a predetermined value or greater, controller 8 puts switching part 7 in a closing status and when the flux density is less than the predetermined value, controller 8 puts it in an opening status.

Spring 9 in a coil shape is disposed slightly compressed between a bottom face of operating body 2 and an inner bottom of case 1, resiliently pushing operating body 2 upward. Cover 10 made of insulating resin covers the opening of case 1 at the top. An upper end of operating shaft portion 2A of operating body 2 is protruding upward through cylindrical part 10A which is formed at an upper center part of cover 10. Vehicle switch 15 is constituted as described. Switch 15 is installed interlocked with a brake pedal, for turning on and off of a stop lamp (not illustrated).

When operating shaft portion 2A is pressed, operating body 2 is pushed down while compressing spring 9. Magnet 3 attached to the left side of operating body 2 is then moved down. With this movement, a center of magnet 3 facing a center of detector 6 is largely separated, making the magnetic flux density of magnet 3 detected by detector 6 minute. In this way, when operating body 2 is pushed down, switching part 7 is put in an opening status, keeping the stop lamp in an off status.

When the press-force applied to operating shaft portion 2A is removed, operating body 2 is pushed upward by a resilient restoring force of spring 9. Magnet 3 attached to operating body 2 then moves upward and magnet 3 faces detector 6. At this time, the magnetic flux density of magnet 3 detected by detector 6 becomes large. Controller 8 thus switches switching part 7 to the closing status, turning the stop lamp on.

Namely, when a driver operates a brake pedal and moves operating body 2 up and down, controller 8 switches the on/off status of switching part 7 in response to a magnitude of the magnetism of magnet 3 attached to operating body 2. With this operation, the stop lamp is turned on and off.

The brake pedal is usually attached to a lower end of an arm (not illustrated). An upper end of the arm is attached to a vehicle, serving as a fulcrum. The arm, therefore, turns around the fulcrum. Because of this constitution, when the upper end of operating shaft portion 2A of switch 15 is contacted with the arm, the end of shaft portion 2A is obliquely pressed. With this structure, operating body 2 moves up and down slanting in a small gap between an outer peripheral part of operating shaft portion 2A and an internal peripheral part of cylindrical part 10A. It causes a positional discrepancy of magnet 3 to detector 6, and therefore, an error in detecting magnetism of magnet 3 will occur when operating body 2 moves up and down.

SUMMARY OF THE INVENTION

A vehicle switch of the present invention includes a case, a movable body, a spring, a magnet, a detector, and an operating shaft. The movable body is reciprocably accommodated in the case. The spring pushes the movable body in a direction away from an internal bottom of the case. The magnet is attached to the movable body. The detector detects a magnetic flux density generated from the magnet. A lower end of the operating shaft is in contact with the movable body. The movable body has a press contact portion with which the operating shaft is in contact at a point or along a line.

DETAILED DESCRIPTION OF THE PREFERRED EMBODIMENT

Figure 1:
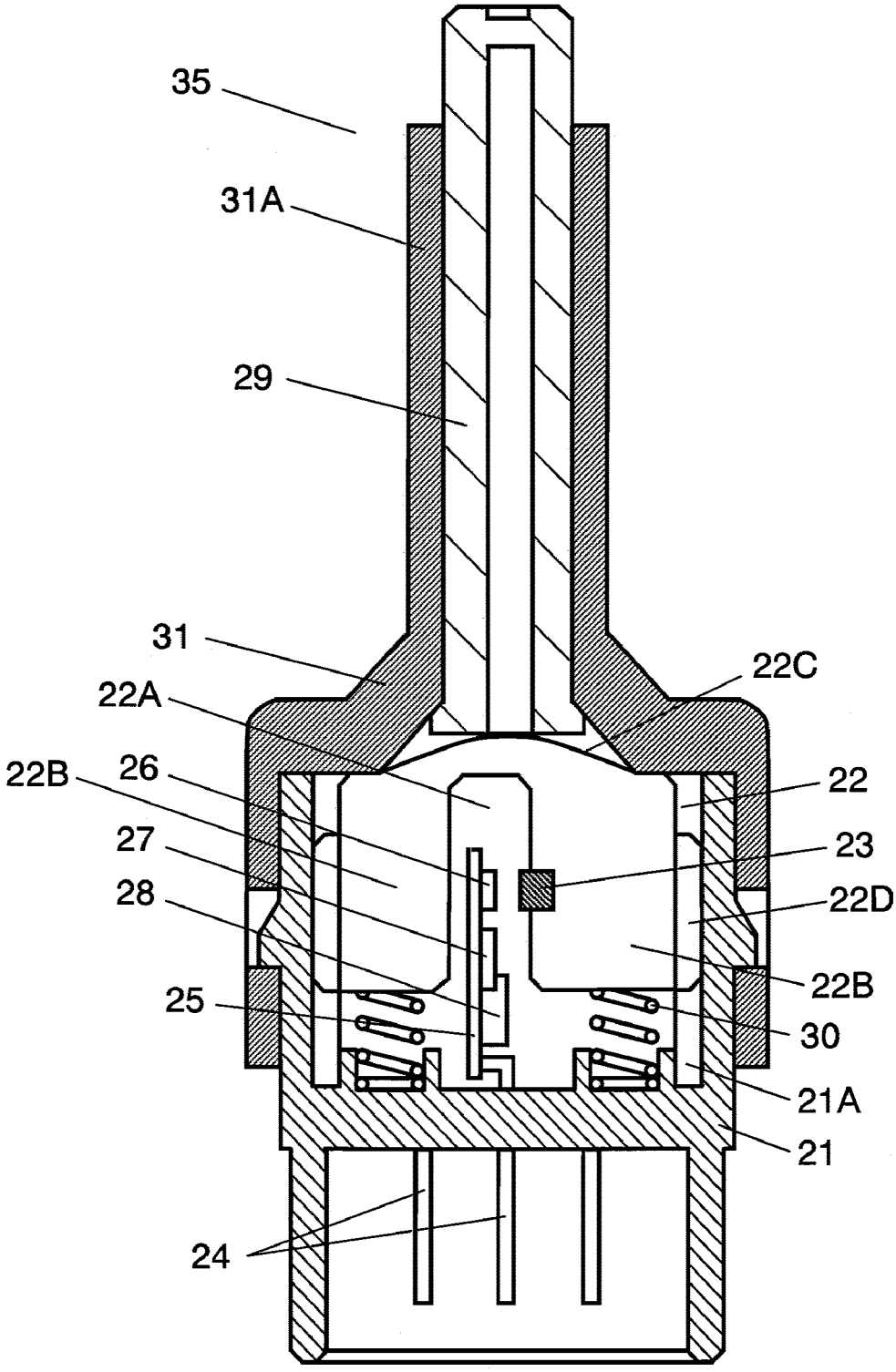
FIG. 1 is a cross sectional view of a vehicle switch in accordance with an embodiment of the present invention.
Figure 2:
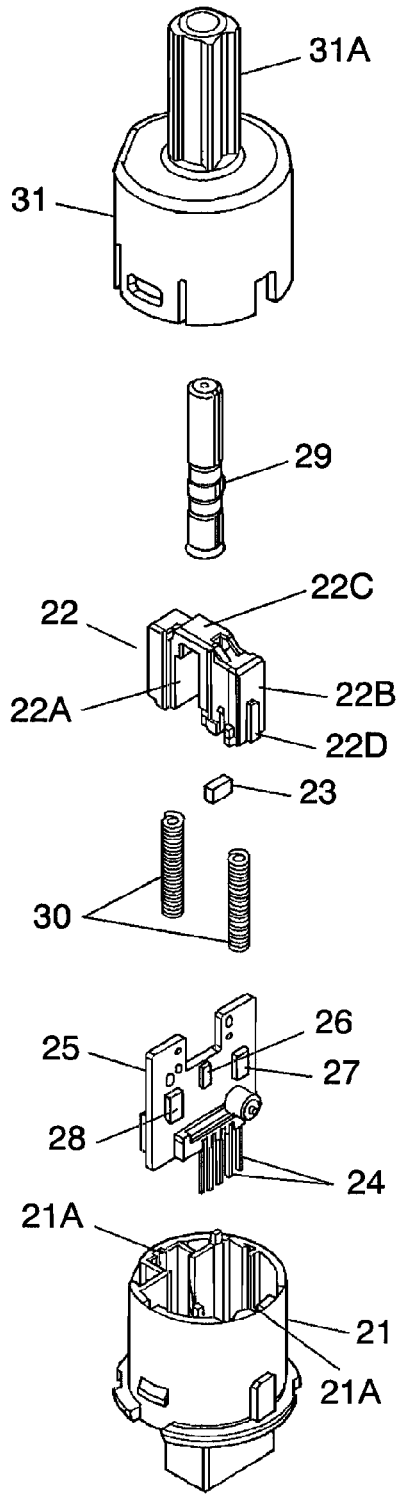
FIG. 2 is an exploded perspective view of the vehicle switch illustrated in FIG. 1.
Figure 3:
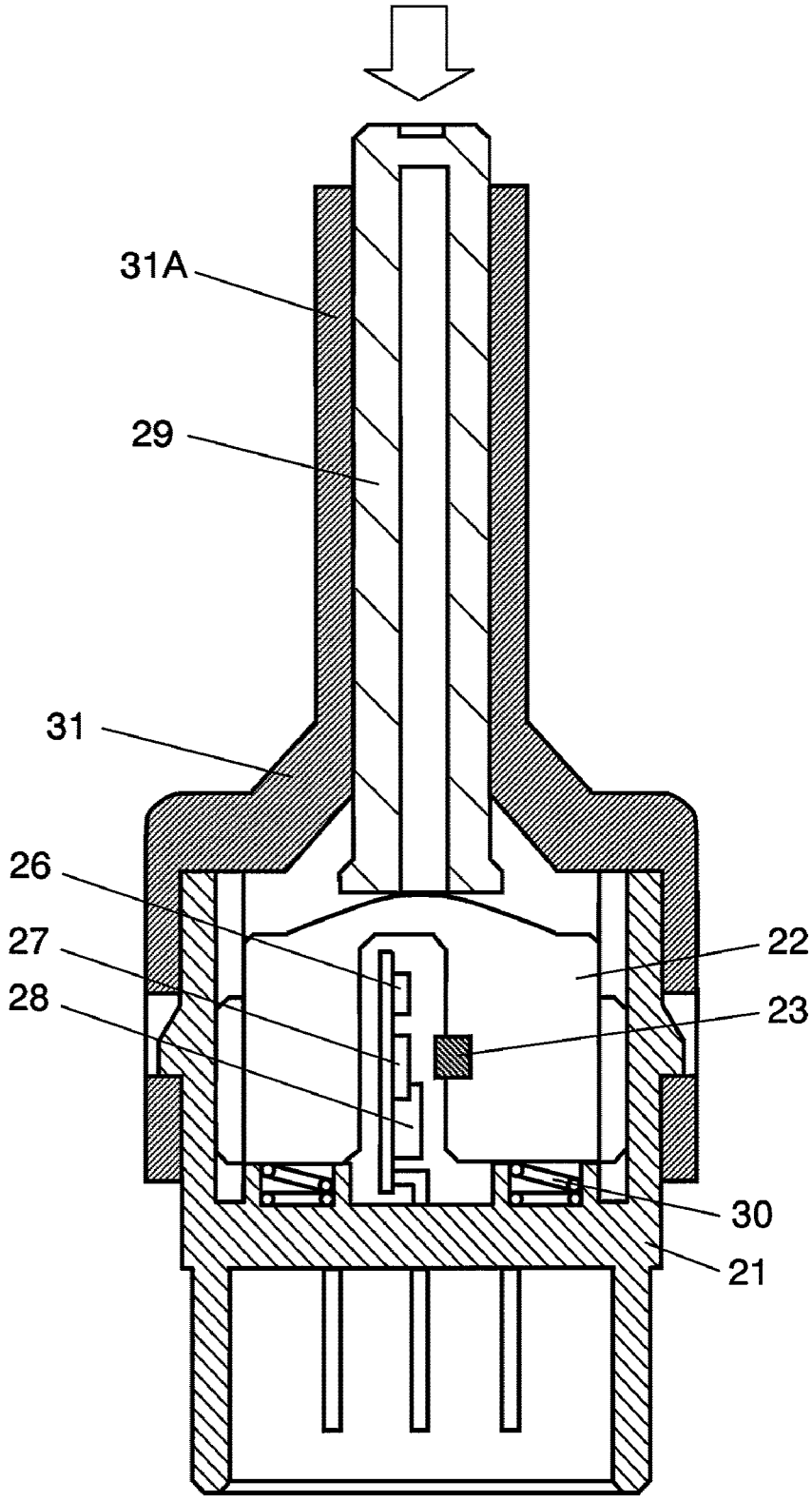
FIG. 3 is a cross sectional view of the vehicle switch illustrated in FIG. 1 being pushed down.
Figure 4:
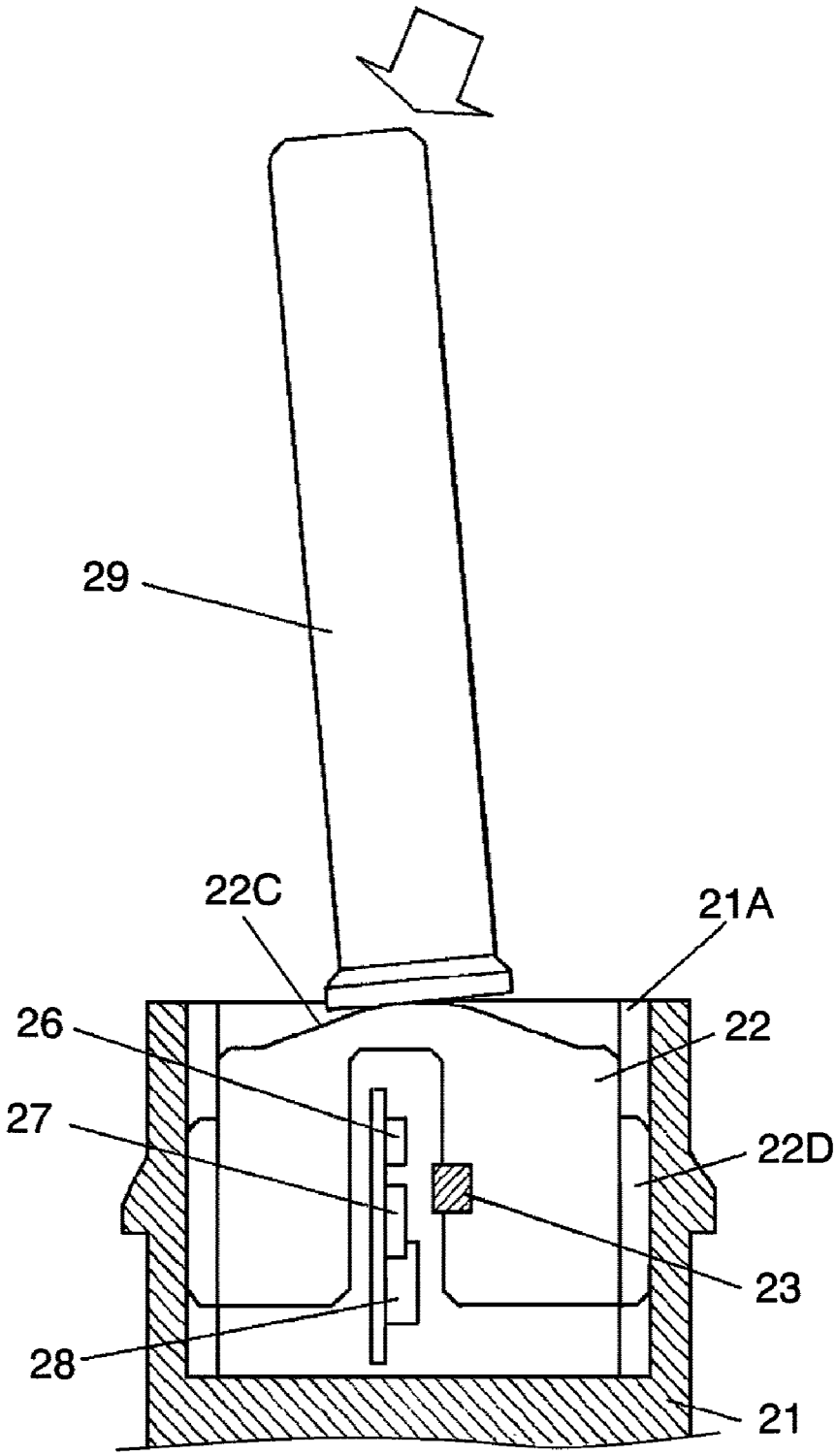
FIG. 4 is a part of the cross sectional view of the vehicle switch illustrated in FIG. 1 being pushed down.
Figure 5:
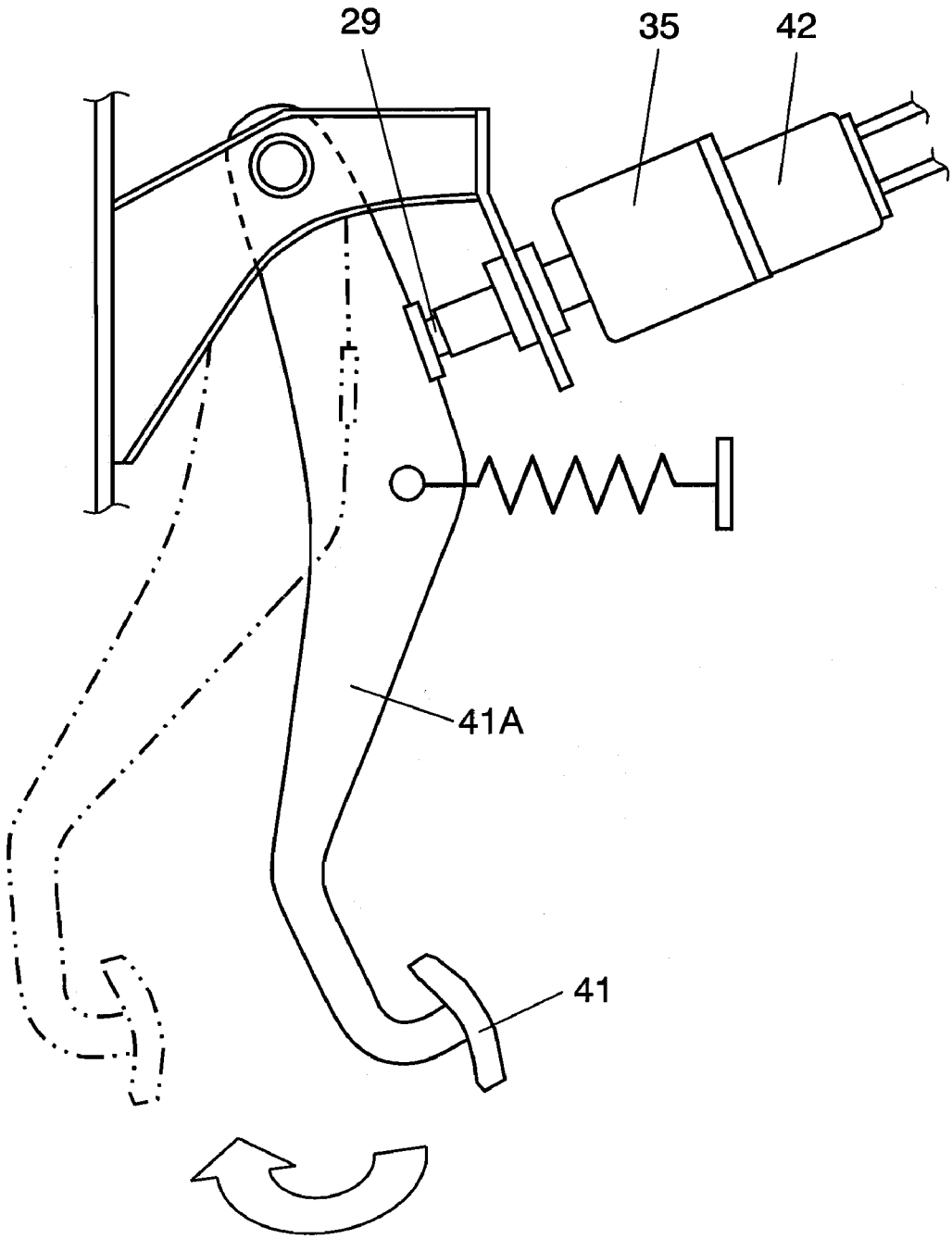
FIG. 5 is a side view of an essential portion of a brake pedal assembly in which the vehicle switch illustrated in FIG. 1 is installed.

FIG. 1 is a cross sectional view of a vehicle switch in accordance with an embodiment of the present invention. FIG. 2 is an exploded perspective view of the same. FIG. 3 is a cross sectional view of the same being pushed down. FIG. 4 is a part of the cross sectional view of the same being pushed down. FIG. 5 is a side view of an essential portion of a brake pedal assembly in which the vehicle switch is installed. Switch 35 has case 21, movable body 22, spring 30, magnet 23, detector 26, and operating shaft 29.

Case 21 is formed essentially in a box shape, and is made of electrically insulating resin such as polybutylene terephthalate and acrylonitrile butadiene styrene. A top of case 21 is open. Movable body 22 is formed essentially in a letter C shape and is also made of insulating resin. A pair of holding portions 22B is formed on both of lower middle sides of movable body 22, so as to sandwich vacant space 22A. Magnet 23 is attached to one of holding portions 22B, facing vacant space 22A. The N-pole or the S-pole of magnet 23 is directed toward vacant space 22A. Movable body 22 is disposed so that vacant space 22A is positioned at almost a center of case 21.

On a top of movable body 22, press contact portion 22C is formed in a spherical shape and is protruding upward. On both outermost sides of holding portions 22B, convex parts 22D are formed. Each convex part 22D is fit into a groove 21A of case 21. Movable body 22 is accommodated in case 21 movably in up and down directions. In other words, movable body 22 is accommodated in case 21 reciprocably.

Wiring board 25 is positioned inside vacant space 22A. Wiring patterns (not illustrated) are formed on both right and left sides of wiring board 25. Terminals 24 are made of metal such as a copper alloy. An upper end of terminal 24 is connected to one of the wiring patterns of wiring board 25 by soldering for instance, and a lower end of terminal 24 is projected downward from a bottom of case 21.

Detector 26 is formed on wiring board 25, facing magnet 23. Switching unit 27 and controller 28 are also formed on wiring board 25. Detector 26 includes a hall element, and switching unit 27 includes a power transistor. Controller 28 includes an FET and fixed resistors. Detector 26 and switching unit 27 are electrically connected to controller 28. Detector 26 detects a magnetic flux density generated from magnet 23.

Operating shaft 29 is made of insulating resin, and is formed essentially in a cylindrical column shape. A lower end (a first end) of operating shaft 29 is in contact with press contact portion 22C on the top of movable body 22. In other words, operating shaft 29 is formed separately from movable body 22.

Each of springs 30 in a coil shape is disposed between a bottom face of holding portion 22B of movable body 22 and a inner bottom of case 21, while slightly compressed and resiliently pushing up movable body 22 and operating shaft 29. In other words, springs 30 push up movable body 22 in a direction away from an internal bottom of case 21.

Cover 31 also made of insulating resin covers the opening of case 21 on the top. Operating shaft 29 is inserted through cylindrical part 31A formed in an upper central part of cover 31, movably in up and down directions inside cylindrical part 31A. That is, operating shaft 29 is disposed inside cover 31 reciprocably in a same direction as movable body 22. An upper end (a second end) of operating shaft 29 protrudes upward through cylindrical part 31A. Vehicle switch 35 is thus constituted.

Switch 35 is usually installed in a front side of brake pedal 41 of a vehicle with the upper end of operating shaft 29 pressed by arm 41A, as is shown in FIG. 5. Terminals 24 projected from the bottom of case 21 are connected to a stop lamp, an ignition switch, a battery and an electronic circuit (none is illustrated) of the vehicle with connector 42, lead wires, and the like.

That is, when brake pedal 41 is not pressed down, the upper end of operating shaft 29 is kept pressed by arm 41A, as shown in FIG. 3. Accordingly, movable body 22 is pushed down while depressing springs 30 and moving magnet 23 down. In this status, a center of magnet 23 is deviated away from a center of detector 26.

Controller 28 connected to detector 26 controls switching unit 27 in response to a magnitude of magnetism detected by detector 26. Namely, controller 28 puts switching unit 27 in a closing status when a magnetic flux density detected by detector 26 is a predetermined value or more. When the magnetic flux density is less than the predetermined value, controller 28 puts switching unit 27 in an opening status. Therefore, when movable body 22 is pushed down, switching unit 27 is put in the opening status, the stop lamp is turned off.

When brake pedal 41 is pressed down, arm 41A leaves the upper end of operating shaft 29, and the press-force to shaft 29 is removed. Movable body 22 is then pushed upward by a resilient restoring force of springs 30, as shown in FIG. 1. With this movement, magnet 23 moves upward and then magnet 23 faces detector 26. In this status, the magnetic flux density generated from magnet 23 detected by detector 26 becomes large. Controller 28 therewith puts switching unit 27 in the closing status, turning the stop lamp on.

As described, operation of brake pedal 41 causes up and down movement of movable body 22, and then controller 28 switches switching unit 27 between the opening and closing status in response to the magnitude of magnetism generated from magnet 23 attached to movable body 22. The stop lamp is thus turned on and off.

When switch 35 installed on a vehicle is pressed, the upper end of operating shaft 29 is actually pushed obliquely by arm 41A, as shown in FIG. 4, so that operating shaft 29 moves up and down tilting in a gap between an outer circumference of operating shaft 29 and an inner circumference of cylindrical part 31A. However, since the lower end of operating shaft 29 is in contact with press contact portion 22C which has the spherical shape, movable body 22 moves up and down almost vertically.

As mentioned, even if operating shaft 29 is obliquely (diagonally) pushed, since the lower end of operating shaft 29 is in contact with press contact portion 22C of the spherical shape on the top of movable body 22, the oblique force applied to operating shaft 29 is not applied to movable body 22. Movable body 22 is guided by grooves 21A of case 21 into which convex parts 22D formed at each side of movable body 22 fit, and movable body 22 moves in up and down directions almost vertically.

Press contact portion 22C is in contact with the lower end of operating shaft 29 at a point or along a line. It prevents movable body 22 from tilting. Accordingly, magnet 23 attached to movable body 22 does not deviate from its ordinary positions with respect to detector 26. As a result, detector 26 detects a change in the magnetic flux density generated from magnet 23 with the up and down movement of movable body 22, securely and without an error.

Figure 6:
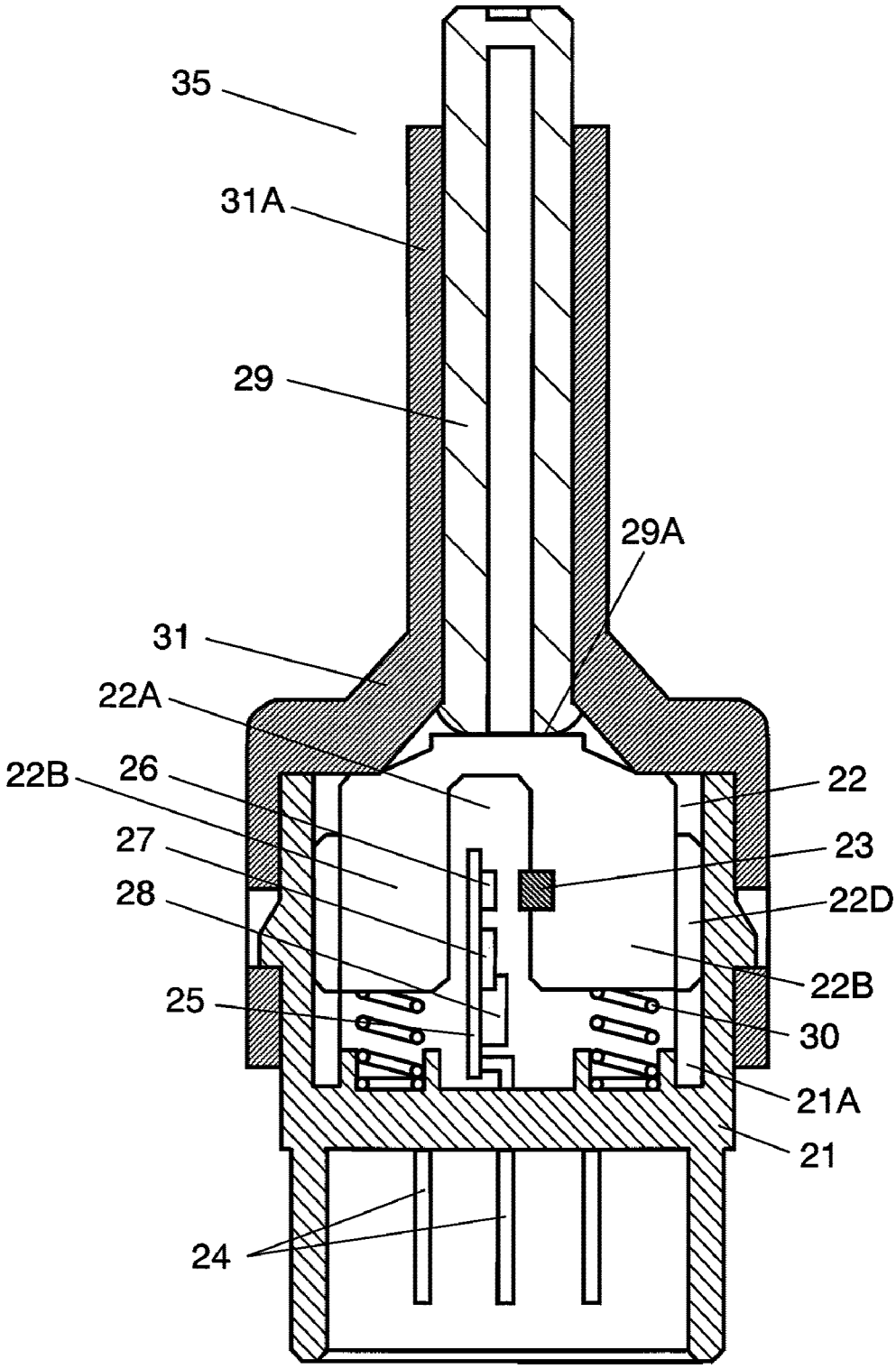
FIG. 6 is a cross sectional view of another vehicle switch in accordance with the embodiment of the invention.
Figure 7:
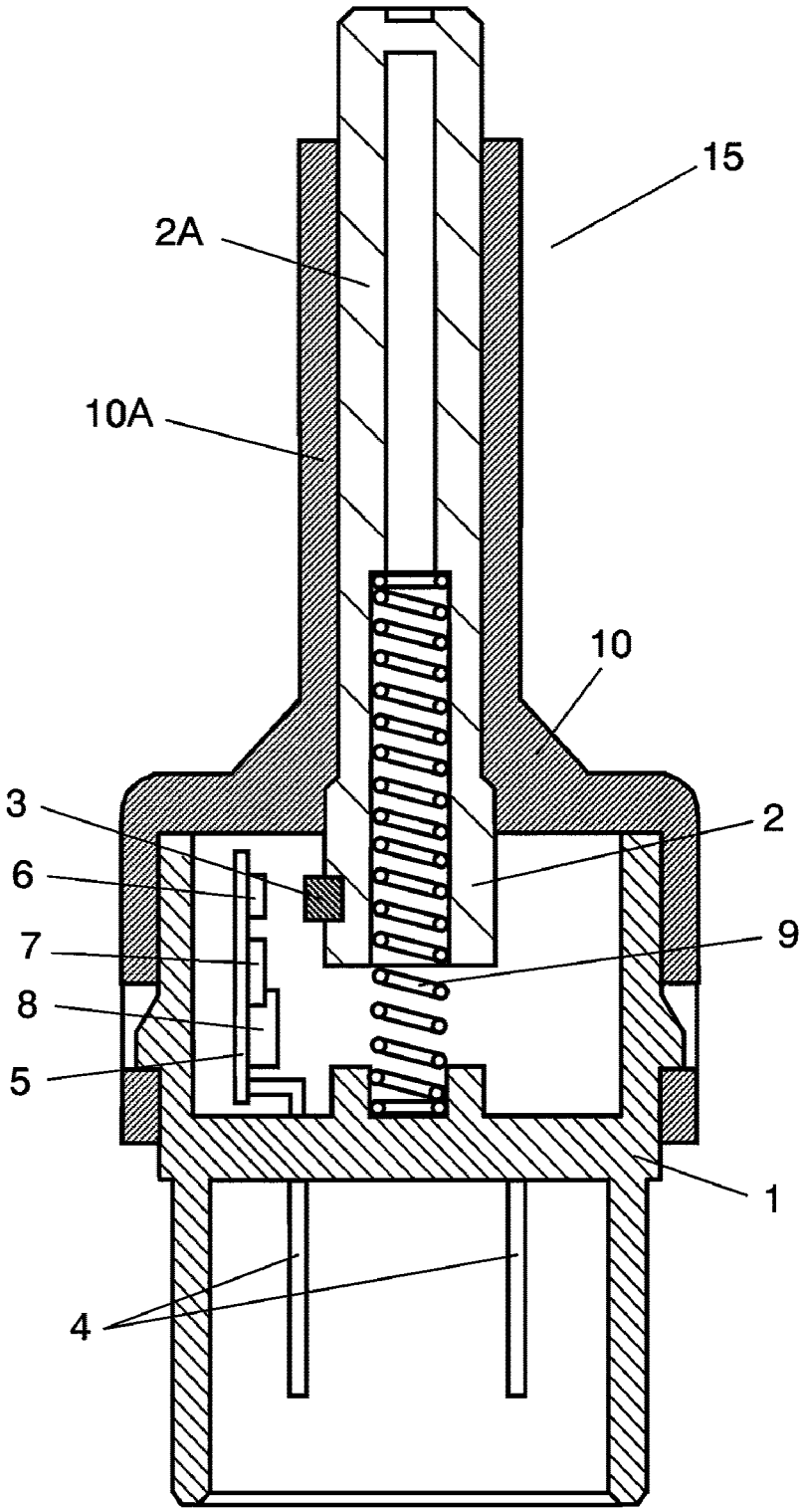
FIG. 7 PRIOR ART
FIG. 7 is a cross sectional view of a conventional vehicle switch.

In the above-mentioned explanation, press contact portion 22C is formed in a spherical shape on the top of movable body 22, with which the lower end of operating shaft 29 is in contact. However, as shown in FIG. 6, the top of movable body 22 may be formed in a flat shape and lower end 29A of operating shaft 29 may be formed in a spherical shape. Furthermore, lower end 29A of operating shaft 29 may be formed in a spherical shape and press contact portion 22C on the top of movable body 22 may also be formed in a spherical shape. These constitutions as well prevent operating shaft 22 from tilting, and thus, a similar effect can be obtained.

When operating shaft 29 is tilted in a specific direction, press contact portion 22C and lower end 29A of operating shaft 29 may be in a shape of a cylindrical side face besides the spherical shape. Press contact portion 22C and the lower end of operating shaft 29 may be adequately contacted at a point or along a line.

As mentioned, even when operating shaft 29 is diagonally pushed, movable body 22 moves up and down almost vertically in switch 35. This structure prevents a positional discrepancy between magnet 23 of movable body 22 and detector 26, enabling a driver to operate switch 35 securely with minimal error.

In the above explanation, a constitution is explained in which switching unit 27 and controller 28, as well as detector 26, are formed on wiring board 25 in case 21. However, the invention is not limited to this constitution. Switching unit 27 and controller 28 can be formed on an electronic circuit of a vehicle and only detector 26 can be formed on wiring board 25.

Furthermore, movable body 22 may be formed in a cylindrical column shape besides a letter C shape. In this case, the movable body may have a slit corresponding to vacant space 22A. Still furthermore, magnet 23 may be attached to an outside surface of movable body 22 and detector 26 may be attached to outside movable body 22. In this case, a single spring may be disposed in vacant space 22A instead of using springs 30.

In the above explanation, a push type vehicle switch which is mainly operated with brake pedal 41 and is used for turning on and off a stop lamp is explained. However, application of the invention is not limited to this case. Switch 35 may be used for realizing other functions including detecting opening and closing of a door.

As demonstrated, positional discrepancy between a magnet and a detector is avoided with the vehicle switch of this invention, and a secure operation is obtained with it. The switch is especially useful for turning on and off a stop lamp of a vehicle.

What is claimed is:

1. A vehicle switch comprising:

a case having an internal bottom;

a movable body reciprocally accommodated in the case;

a magnet attached to the movable body;

a detector disposed in the case so as to face the magnet, the detector being configured to detect a magnetic flux density generated from the magnet; and an operating shaft having a first end and a second end, the first end of the operating shaft being in contact with the movable body; and a spring disposed to push the movable body in a direction away from the internal bottom of the case and into contact with the first end of the operating shaft;

wherein the movable body has a press contact portion with which the first end of the operating shaft is in contact only at a point or only along a line such that the contact between the press contact portion and the first end of the operating shaft constitutes a point contact or a line contact; and wherein the movable body further has a pair of holding portions disposed at outer sides of the press contact portion, each of the holding portions having, at an outer end thereof, a guide portion movably engaged with the case to guide reciprocal movement of the movable body in the case.

2. The vehicle switch according to claim 1, wherein at least one of the first end of the operating shaft and the press contact portion of the movable body has a spherical surface; and the first end of the operating shaft is in contact with the contact portion of the movable body at the spherical surface.

3. The vehicle switch according to claim 2, wherein the movable body has opposite first and second ends, the first end of the movable body facing the first end of the operating shaft, and the second end of the movable body facing towards the internal bottom of the case; and the press contact portion of the movable body, at which the operating shaft contacts the movable body, is constituted by a center portion of the first end of the movable body.

4. The vehicle switch according to claim 1, wherein the case has an opening;

a cover is provided and covers the opening of the case, the cover having a cylindrical part;

the operating shaft is inserted through the cylindrical part of the cover, reciprocally in the cover, in a same direction as the movable body; and the second end of the operating shaft protrudes from the cover.

5. The vehicle switch according to claim 4, wherein the cover further includes an attachment portion that is connected to the cylindrical part and attaches around an outer sidewall of the case.

6. The vehicle switch according to claim 1, wherein the movable body has opposite first and second ends, the first end of the movable body facing the first end of the operating shaft, and the second end of the movable body facing towards the internal bottom of the case; and the press contact portion of the movable body, at which the operating shaft contacts the movable body, is constituted by a center portion of the first end of the movable body.

7. The vehicle switch according to claim 1, wherein the guide portions of the holding portions are respectively constituted by convex parts; and the case has grooves formed in an internal wall thereof, and the guide portions are respectively reciprocably engaged in the grooves.

8. The vehicle switch according to claim 1, wherein the movable body has a vacant space defined between the holding portions; and a support member is disposed in the case and supports the detector in the vacant space between the holding portions.

9. The vehicle switch according to claim 8, wherein the support member is constituted by a wiring board.

10. A vehicle switch comprising:

a case having an internal bottom;

a movable body reciprocally accommodated in the case;

a magnet attached to the movable body;

a detector disposed in the case so as to face the magnet, the detector being configured to detect a magnetic flux density generated from the magnet; and an operating shaft having a first end and a second end, the first end of the operating shaft being in contact with the movable body; and a spring disposed to push the movable body in a direction away from the internal bottom of the case and into contact with the first end of the operating shaft;

wherein the movable body has opposite first and second ends, the first end of the movable body facing the first end of the operating shaft, and the second end of the movable body facing towards the internal bottom of the case;

wherein the first end of the movable body has a press contact portion formed thereon, said press contact portion being in contact with the first end of the operating shaft at a point or along a line located at a center portion of the first end of the movable body; and wherein the movable body further has a pair of holding portions disposed at outer sides of the press contact portion, each of the holding portions having, at an outer end thereof, a guide portion movably engaged with the case to guide reciprocal movement of the movable body in the case.

11. The vehicle switch according to claim 10, wherein at least one of the press contact portion of the movable body and the first end of the operating shaft has a spherical surface in contact with the other of the press contact portion of the movable body and the first end of the operating shaft.

12. The vehicle switch according to claim 11, wherein the case has an opening;

a cover is provided and covers the opening of the case, the cover having a cylindrical part;

the operating shaft is inserted through the cylindrical part of the cover, reciprocally in the cover, in a same direction as the movable body; and the second end of the operating shaft protrudes from the cover.

13. The vehicle switch according to claim 10, wherein the case has an opening;

a cover is provided and covers the opening of the case, the cover having a cylindrical part;

the operating shaft is inserted through the cylindrical part of the cover, reciprocally in the cover, in a same direction as the movable body; and the second end of the operating shaft protrudes from the cover.

14. The vehicle switch according to claim 13, wherein the cover further includes an attachment portion that is connected to the cylindrical part and attaches around an outer sidewall of the case.

15. The vehicle switch according to claim 10, wherein the guide portions of the holding portions are respectively constituted by convex parts; and the case has grooves formed in an internal wall thereof, and the guide portions are respectively reciprocably engaged in the grooves.

16. The vehicle switch according to claim 10, wherein the movable body has a vacant space defined between the holding portions; and a support member is disposed in the case and supports the detector in the vacant space between the holding portions.

17. The vehicle switch according to claim 16, wherein the support member is constituted by a wiring board.

* * * * *